US011835056B2

(12) United States Patent
Tan

(10) Patent No.: US 11,835,056 B2
(45) Date of Patent: Dec. 5, 2023

(54) MULTI-FAN SYSTEM AND DRIVING METHOD THEREOF

(71) Applicant: Midastek Microelectronics Inc., Taipei (TW)

(72) Inventor: Chung-Ping Tan, Taipei (TW)

(73) Assignee: Midastek Microelectronics Inc., Taipel (TW)

( * ) Notice: Subject to any disclaimer, the term of this patent is extended or adjusted under 35 U.S.C. 154(b) by 19 days.

(21) Appl. No.: 17/860,062

(22) Filed: Jul. 7, 2022

(65) Prior Publication Data

US 2023/0313810 A1 Oct. 5, 2023

(30) Foreign Application Priority Data

Mar. 29, 2022 (TW) ..... 111111821

(51) Int. Cl.
*F04D 25/16* (2006.01)
*F04D 27/00* (2006.01)

(52) U.S. Cl.
CPC ..... *F04D 27/004* (2013.01); *F04D 25/166* (2013.01)

(58) Field of Classification Search
CPC ..... F04D 25/166
See application file for complete search history.

(56) References Cited

U.S. PATENT DOCUMENTS 9,188,355 B1 * 11/2015 Allen ..... F24F 11/77
2018/0192493 A1 * 7/2018 Kinstle, III ..... G06F 1/181
2019/0219060 A1 * 7/2019 Stefankiewicz ..... F04D 27/001
2019/0220071 A1 * 7/2019 Stefankiewicz ..... H05B 47/19
2021/0293249 A1 9/2021 Stefankiewicz et al.
2022/0376643 A1 * 11/2022 Wang ..... H04L 12/2816

FOREIGN PATENT DOCUMENTS

TW 201635253 10/2016
TW I662412 6/2019
TW I730640 6/2021

OTHER PUBLICATIONS

"Office Action of Taiwan Counterpart Application", dated Jul. 14, 2023, p. 1-p. 8.

* cited by examiner

*Primary Examiner* — Thomas Fink
(74) *Attorney, Agent, or Firm* — JCIPRNET

(57) ABSTRACT

A multi-fan system and a driving method for the multi-fan system are provided. The multi-fan system includes a control source circuit and multiple electronic devices. The control source circuit includes a driving signal output terminal. The control source circuit outputs a device driving signal string through the driving signal output terminal. The device driving signal string includes multiple device driving signals with different identification codes. Each of the electronic devices includes a driving signal input terminal, a fan, a light emitting element group, and a controller. The controller receives a corresponding device driving signal in the device driving signal string through the driving signal input terminal. The corresponding device driving signal has a corresponding identification code corresponding to a corresponding electronic device. The controller controls an operation of at least one of the fan and the light emitting element group based on the corresponding device driving signal.

18 Claims, 16 Drawing Sheets

MULTI-FAN SYSTEM AND DRIVING METHOD THEREOF

CROSS-REFERENCE TO RELATED APPLICATION

This application claims the priority benefit of Taiwan application serial no. 111111821, filed on Mar. 29, 2022. The entirety of the above-mentioned patent application is hereby incorporated by reference herein and made a part of this specification.

BACKGROUND

Technical Field

The disclosure relates to a multi-fan system and a driving method thereof, and particularly to a multi-fan system and a driving method thereof capable of driving multiple fans of the multi-fan system and multiple light emitting elements.

Description of Related Art

Please refer to FIG. 1A. FIG. 1A is a schematic diagram of a conventional electronic device. In addition to power source terminals PWR and GND, a conventional electronic device 10 includes a fan 11 and the electronic device 10 of a light emitting element group 12 receives a fan driving signal SD_FAN via an input terminal T1, and drives the fan 11 by the fan driving signal SD_FAN. The electronic device 10 outputs a feedback signal FG of the fan 11 via an output terminal T2. In addition, the electronic device 10 also receives a driving voltage V_LED and driving data D1, D2, and D3 for driving the light emitting element group 12 via other input terminals T3 to T6. In FIG. 1A, the light emitting element group 12 provides a light signal based on the driving data D1, D2, and D3 in an analogous form. Please refer to FIG. 1B. FIG. 1B is also a schematic diagram of a conventional electronic device. Different from FIG. 1A, a conventional electronic device 20 also receives the driving voltage V_LED for driving the light emitting element group 12, a light emitting driving signal string DS, and a reference low voltage (for example, ground) via the input terminals T3 to T5. In FIG. 1B, the light emitting element group 12 provides a light signal based on the light emitting driving signal string DS in a digital form.

In FIG. 1A, in order to effectively drive the fan 11 and the light emitting element group 12, the electronic device 10 needs 5 input terminals T1 and T3 to T6. In FIG. 1B, in order to effectively drive the fan 11 and the light emitting element group 12, the electronic device 20 needs 4 input terminals T1 and T3 to T5. It should be noted that a larger number of input terminals will occupy a larger physical space.

Please refer to FIG. 1C. FIG. 1C is a schematic diagram of a conventional multi-fan system. A multi-fan system 30 includes a control source circuit CSC and electronic devices 20_1 to **20_*n*. The electronic devices 20_1 to 20_*n* are respectively implemented by the conventional electronic device 20 shown in FIG. 1B. It should be noted that the conventional electronic device 20 has 7 terminals (the input terminals T1 to T5 and the power source terminals PWR and GND). Therefore, the control source circuit CSC may need 7×n terminals to control the electronic devices 20_1 to 20_*n***. A larger number of terminals will occupy a larger physical space of the control source circuit CSC and consume more wire costs.

Therefore, how to effectively reduce the number of input terminals to reduce the volume of the electronic device and save wire costs is one of the research focuses of persons skilled in the art.

SUMMARY

The disclosure provides a multi-fan system and a driving method thereof capable of driving multiple fans of the multi-fan system and multiple light emitting elements. In addition, the multi-fan system and the driving method thereof of the disclosure can effectively reduce the number of input terminals to reduce the volume of the electronic device and save wire costs.

The multi-fan system of the disclosure includes a control source circuit and multiple electronic devices. The control source circuit includes a driving signal output terminal. The control source circuit outputs a device driving signal string through the driving signal output terminal. The device driving signal string includes multiple device driving signals with different identification codes. The electronic devices are commonly coupled to the driving signal output terminal. Each of the electronic devices includes a driving signal input terminal, a fan, a light emitting element group, and a controller. The driving signal input terminal is electrically connected to the driving signal output terminal. The controller is coupled to the fan, the light emitting element group, and the driving signal input terminal. The controller receives a corresponding device driving signal in the device driving signal string through the driving signal input terminal. The corresponding device driving signal has a corresponding identification code corresponding to a corresponding electronic device among the electronic devices. The controller controls an operation of at least one of the fan and the light emitting element group based on the corresponding device driving signal.

The driving method of the disclosure is used for a multi-fan system. The multi-fan system includes a control source circuit and multiple electronic devices. The control source circuit is electrically connected to the electronic devices. The control source circuit includes a driving signal output terminal. Each of the electronic devices includes a driving signal input terminal, a fan, and a light emitting element group. The driving method includes the following steps. A device driving signal string is output by the control source circuit through the driving signal output terminal of the control source circuit. The device driving signal string includes multiple device driving signals with different identification codes. A corresponding device driving signal in the device driving signal string is received by each of the electronic devices through the driving signal input terminal. The corresponding device driving signal has a corresponding identification code corresponding to a corresponding electronic device among the electronic devices. An operation of at least one of the fan and the light emitting element group is controlled by each of the electronic devices based on the corresponding device driving signal.

Based on the above, each of the electronic devices is connected to the driving signal output terminal of the control source circuit through the driving signal input terminal to receive the corresponding device driving signal. The electronic devices respectively control the operation of at least one of the fan and the light emitting element group based on the corresponding device driving signal. Therefore, the disclosure can enable the electronic device to drive at least one of the fan and the light emitting element group by using a signal received by the driving signal input terminal. In this way, the disclosure can reduce the number of input terminals of the electronic device and the number of output terminals of the control source circuit, thereby reducing the volumes of the control source circuit and the electronic device and saving wire costs.

In order for the features and advantages of the disclosure to be more comprehensible, the following specific embodiments are described in detail in conjunction with the drawings.

DETAILED DESCRIPTION OF DISCLOSED EMBODIMENTS

Figure 1A:
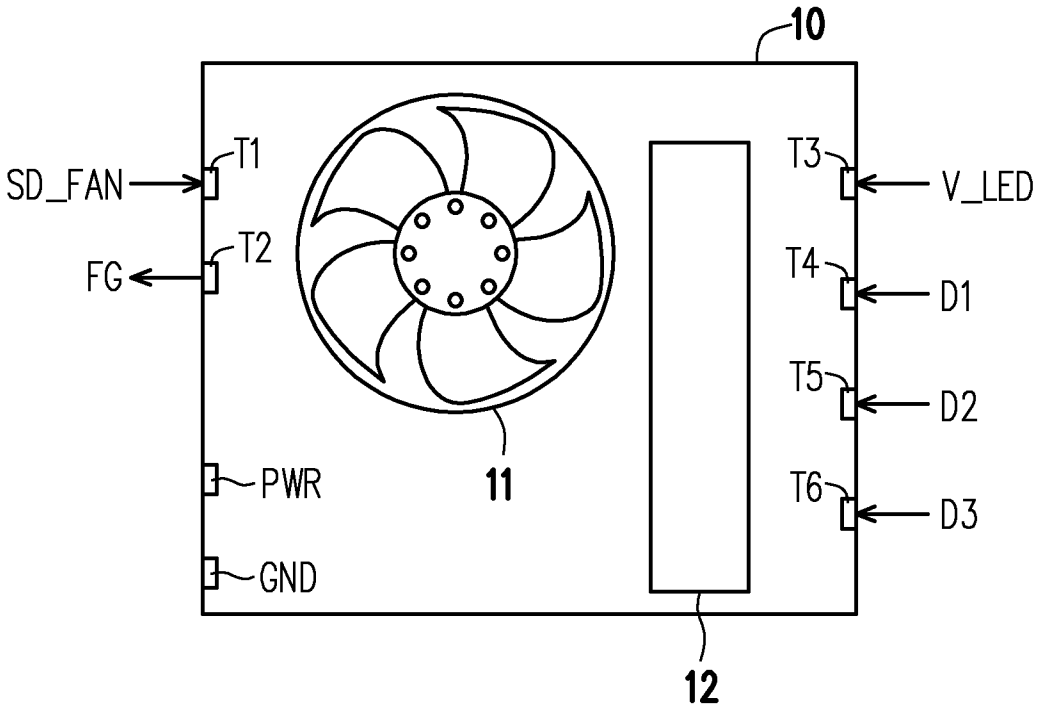
FIG. 1A is a schematic diagram of a conventional electronic device.
Figure 1B:
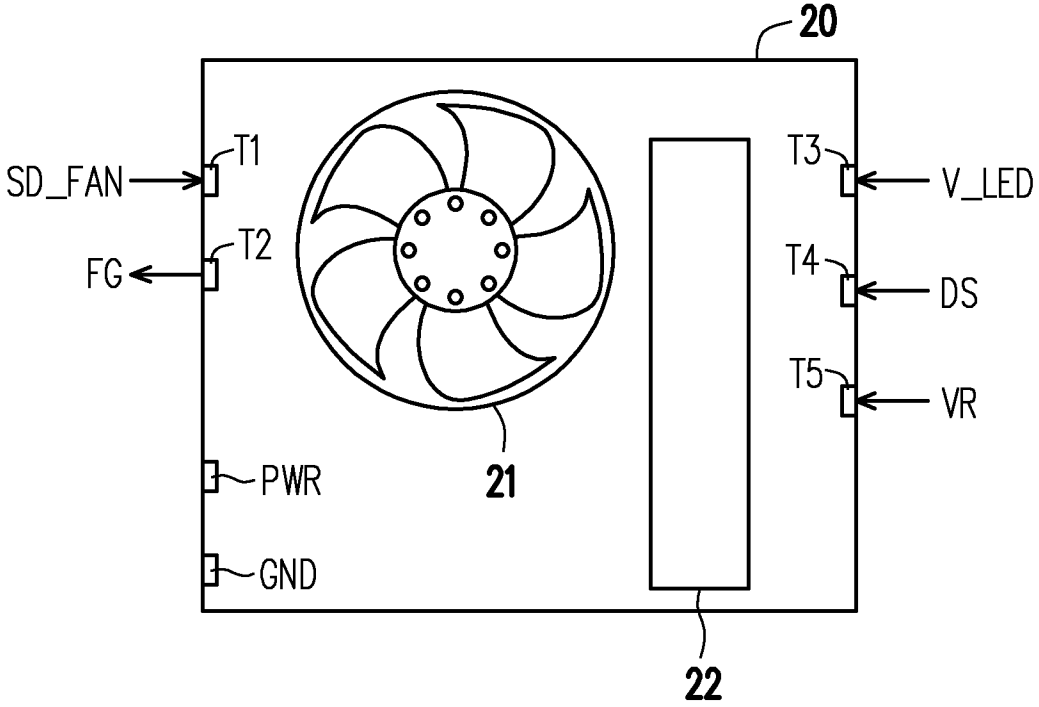
FIG. 1B is a schematic diagram of a conventional electronic device.

A part of the embodiments of the disclosure will be described in detail with reference to the drawings. The reference numerals in the following description will be regarded as referring to the same or similar elements when the same reference numerals appear in different drawings. The embodiments are only a part of the disclosure and do not disclose all possible implementations of the disclosure. Specifically, the embodiments are only examples within the protection scope of the disclosure.

Figure 2:
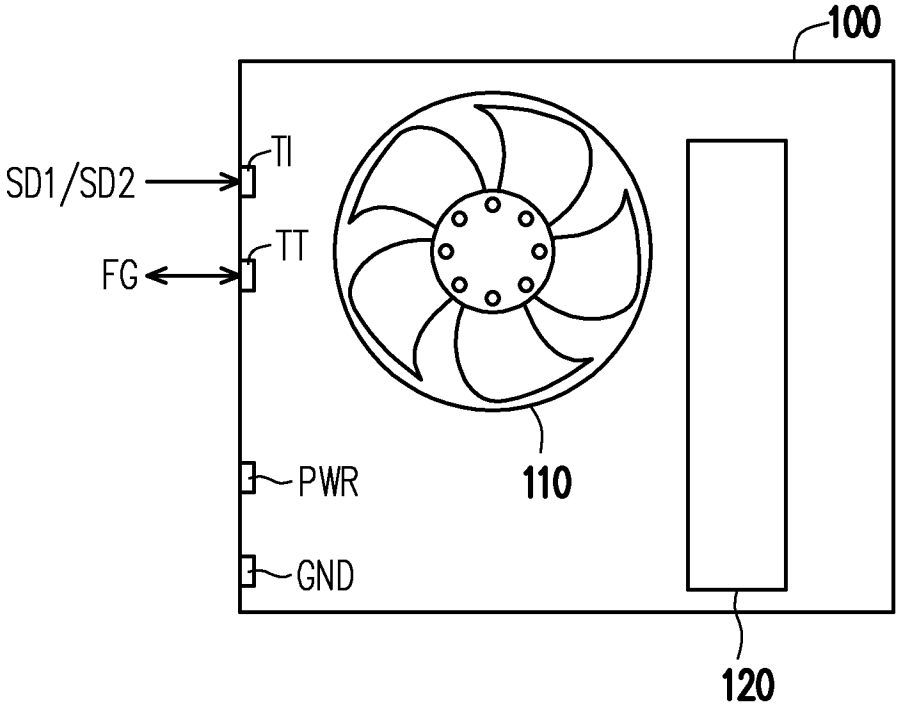
FIG. 2 is a schematic diagram of an electronic device according to a first embodiment of the disclosure.

Please refer to FIG. 2. FIG. 2 is a schematic diagram of an electronic device according to a first embodiment of the disclosure. In the embodiment, an electronic device 100 can effectively control operations of a fan 110 and a light emitting element group 120 only by using signals received by a driving signal input terminal TI and a signal transmission terminal TT. Therefore, the volume of the electronic device can be reduced.

Figure 3:
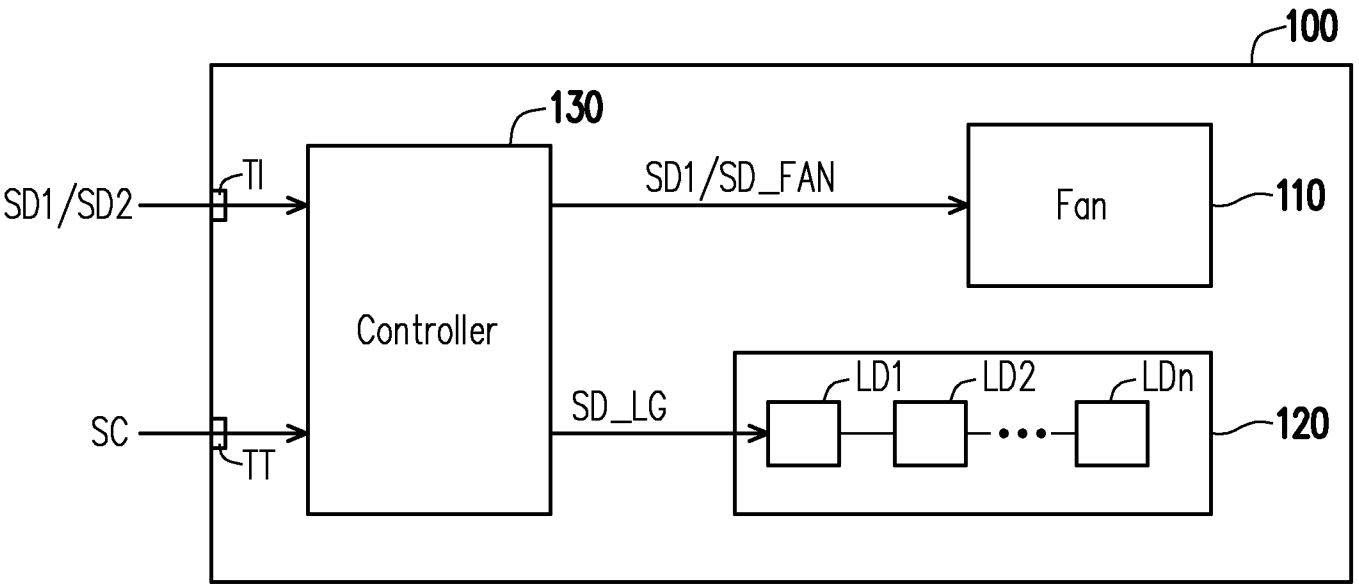
FIG. 3 is another schematic diagram of the electronic device according to the first embodiment of the disclosure.
Figure 4:
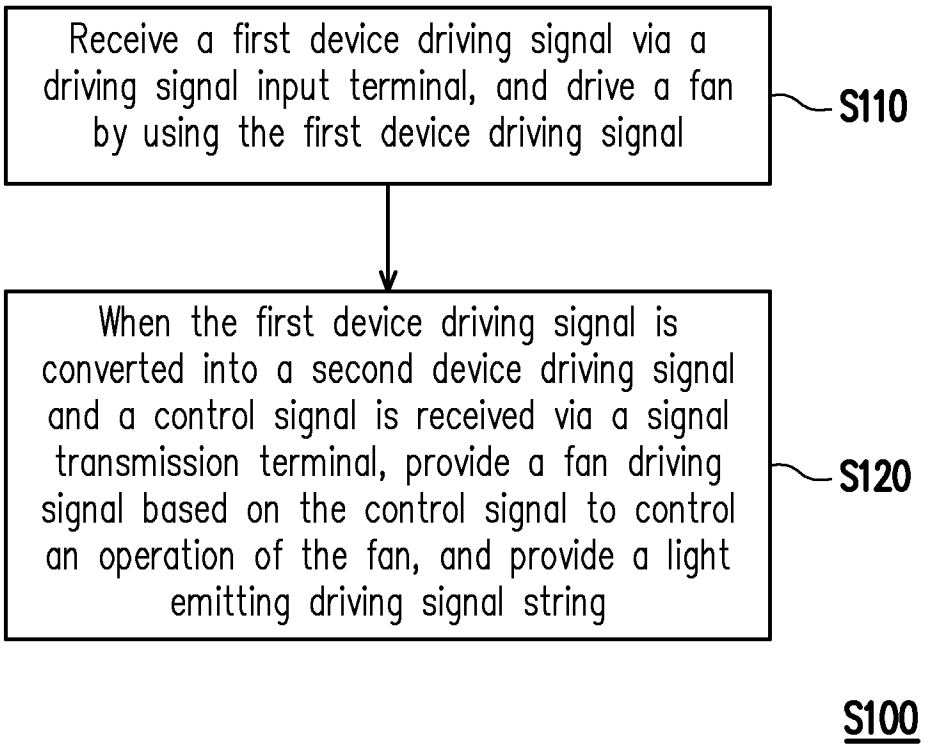
FIG. 4 is a flowchart of a first method of a driving method according to an embodiment of the disclosure.

Specifically, please refer to FIG. 3 and FIG. 4 at the same time. FIG. 3 is another schematic diagram of the electronic device according to the first embodiment of the disclosure. FIG. 4 is a flowchart of a first method of a driving method according to an embodiment of the disclosure. A driving method S100 of FIG. 4 may be applied to the electronic device 100 of FIG. 3. In the embodiment, the electronic device 100 includes the driving signal input terminal TI, the signal transmission terminal TT, the fan 110, the light emitting element group 120, and a controller 130. In the embodiment, the fan 110 may be any form of a conventional fan element. In the embodiment, the light emitting element group 120 includes multiple light emitting elements LD1 to LDn. The light emitting elements LD1 to LDn may be respectively implemented by elements such as a light emitting diode (LED), a micro LED, and an organic LED (OLED). In the embodiment, the light emitting elements LD1 to LDn are connected in series with each other. It should be noted that the number of connection pins between the light emitting element group 120 and the controller 130 may be reduced by connecting the light emitting elements LD1 to LDn in series. In the embodiment, the light emitting element group 120 operates in response to a light emitting driving signal string SD_LG. The light emitting driving signal string SD_LG includes multiple driving data corresponding to the light emitting elements LD1 to LDn. For example, the light emitting element LD1 may be driven by first driving data, the light emitting element LD2 may be driven by second driving data, and so on. In some embodiments, the light emitting element group 120 may include only a single light emitting element. The number and the connection manner of light emitting elements of the disclosure are not limited to the embodiment.

In the embodiment, the controller 130 is coupled to the fan 110 and the light emitting element group 120. In Step S110, the controller 130 may receive a device driving signal SD1 via the driving signal input terminal TI, and drive the fan 110 by using the device driving signal SD1. In other words, in Step S110, the controller 130 drives the fan 110 by using the device driving signal SD1 received via the driving signal input terminal TI.

In Step S120, when the device driving signal SD1 is converted into a device driving signal SD2 and a control signal SC is received via the signal transmission terminal TT, the controller 130 provides the fan driving signal SD_FAN based on the control signal SC to control the operation of the fan 110 and provide the light emitting driving signal string SD_LG. In other words, when the device driving signal SD1 is converted into the device driving signal SD2, the controller 130 provides the fan driving signal SD_FAN and the light emitting driving signal string SD_LG based on the control signal SC received via the signal transmission terminal TT. In the embodiment, the controller 130 drives the fan 110 by using the fan driving signal SD_FAN, and drives the light emitting element group 120 by using the light emitting driving signal string SD_LG.

In the embodiment, the device driving signal SD1, the device driving signal SD2, and the fan driving signal SD_FAN are respectively a pulse width modulation (PWM) signal. The fan 110 may provide a fan speed corresponding to a duty cycle based on the duty cycle of one of the device driving signal SD1 and the fan driving signal SD_FAN.

In the embodiment, the device driving signal SD1 and the device driving signal SD2 may be provided by, for example, a driving signal generating circuit.

It is worth mentioning here that the electronic device 100 receives the device driving signal SD1 via the driving signal input terminal TI. When the control signal SC is received via the signal transmission terminal TT during the period of converting the device driving signal SD1 into the device driving signal SD2, the electronic device 100 provides the fan driving signal SD_FAN to drive the fan 110, and provides the light emitting driving signal string SD_LG to drive the light emitting element group 120. The electronic device 100 may drive the fan 110 and the light emitting element group 120 only by using the signals received by the driving signal input terminal TI and the signal transmission terminal TT. Therefore, the electronic device 100 and the driving method S100 of the embodiment can effectively reduce the number of input terminals of the electronic device 100, thereby reducing the volume of the electronic device 100.

In the embodiment, the controller 130 is, for example, a central processing unit (CPU), other programmable general-purpose or specific-purpose microprocessors, digital signal processors (DSPs), programmable controllers, application specific integrated circuits (ASIC), programmable logic devices (PLDs), other similar devices, or a combination of the devices, which may load and execute a computer program.

In the embodiment, the driving signal input terminal TI and the signal transmission terminal TT are disposed outside the controller 130 (for example, disposed on the housing of the electronic device 100). In some embodiments, the driving signal input terminal TI and the signal transmission terminal TT are disposed on the controller 130.

Figure 5:
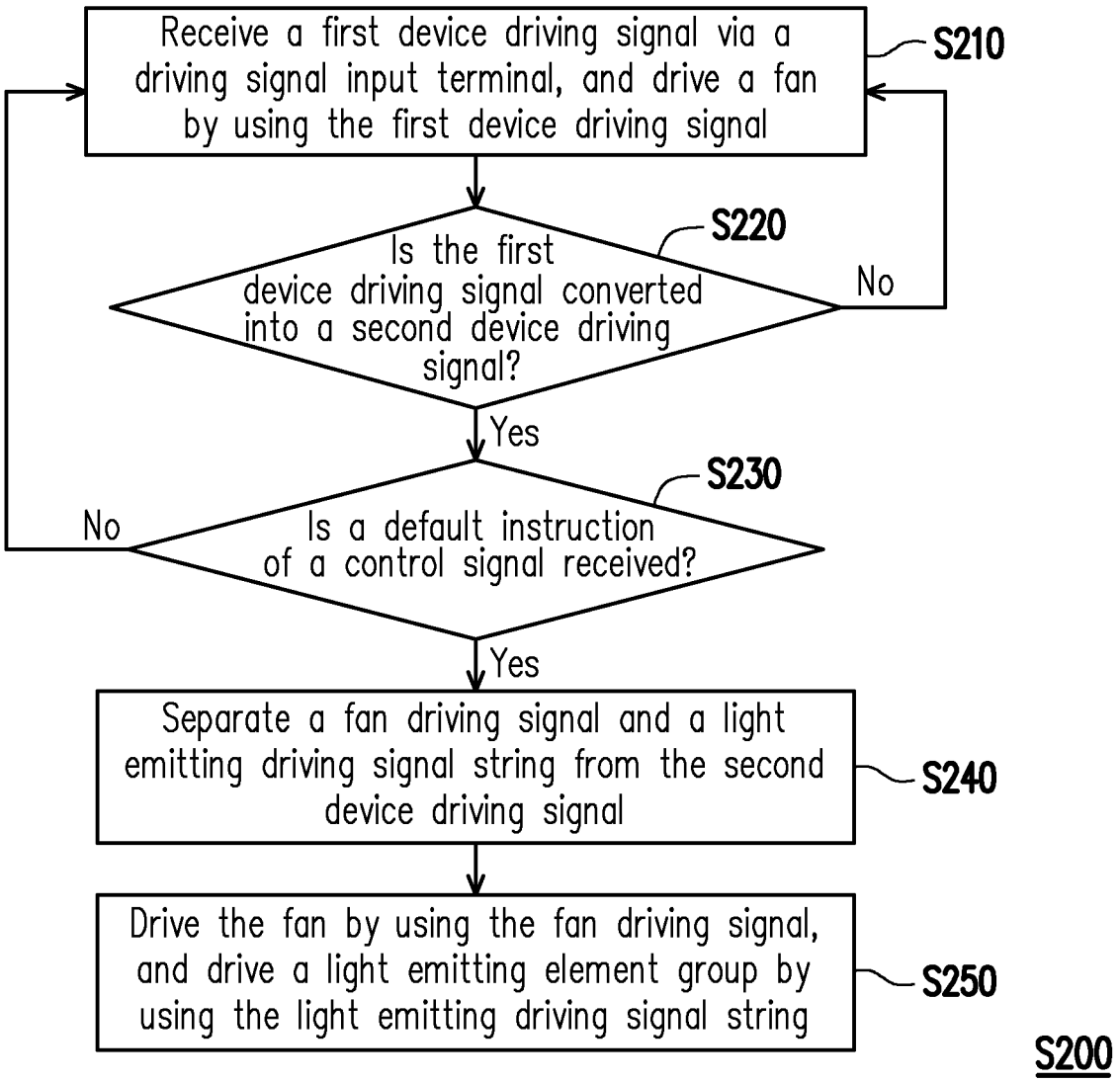
FIG. 5 is a flowchart of a second method of a driving method according to an embodiment of the disclosure.
Figure 6:
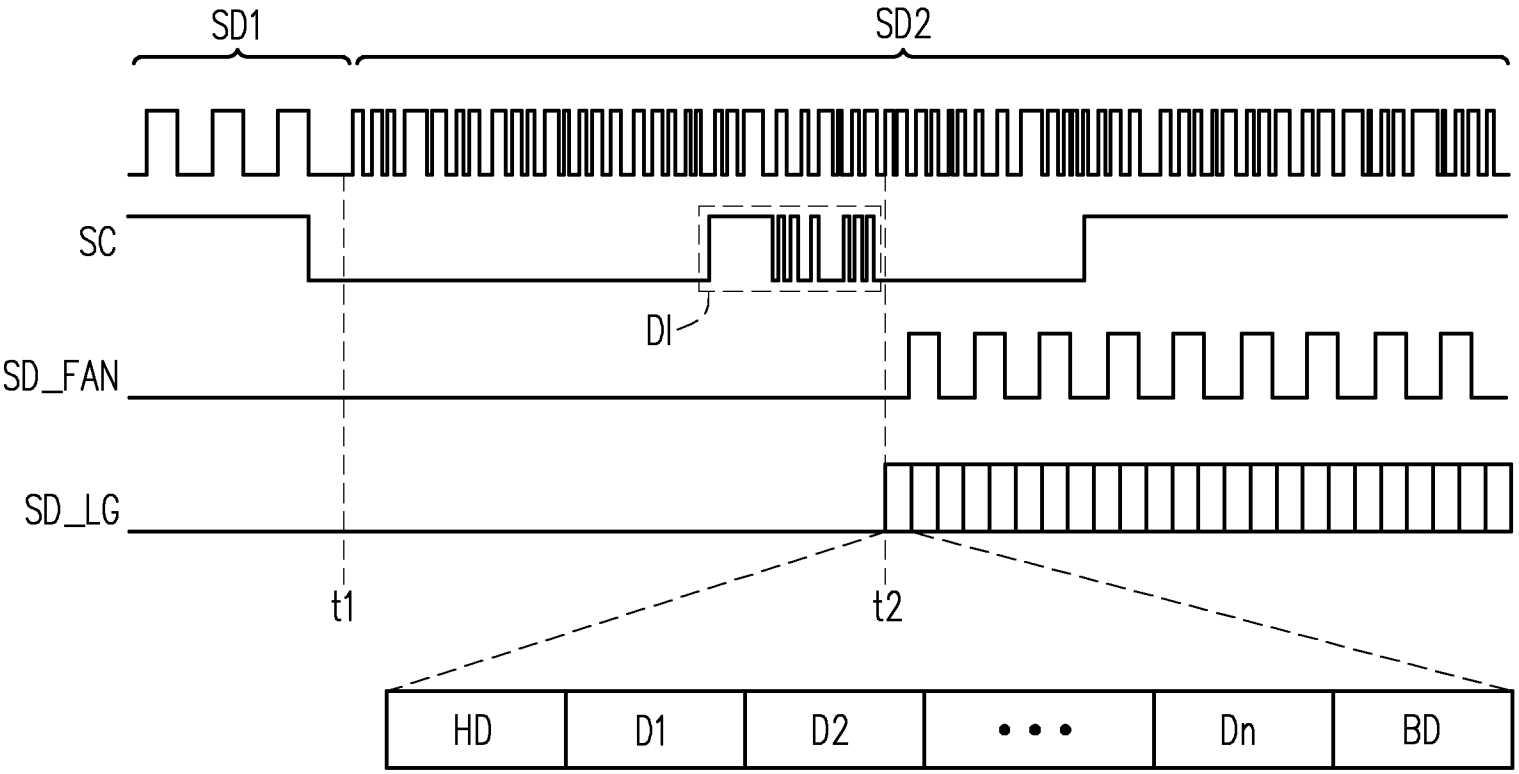
FIG. 6 is a signal timing diagram according to the first embodiment of the disclosure.

Please refer to FIG. 3, FIG. 5, and FIG. 6 at the same time. FIG. 5 is a flowchart of a second method of a driving method according to an embodiment of the disclosure. FIG. 6 is a signal timing diagram according to the first embodiment of the disclosure. A driving method S200 of FIG. 5 and the signal timing diagram of FIG. 6 may be applied to the electronic device 100 of FIG. 3. In Step S210 of the embodiment, the controller 130 drives the fan 110 by using the device driving signal SD1. In Step S220, the controller 130 judges whether the device driving signal SD1 is converted into the device driving signal SD2. In Step S220, if the controller 130 judges that the device driving signal SD1 is not converted into the device driving signal SD2, the driving method S200 returns to Step S210.

On the other hand, if the controller 130 judges that the device driving signal SD1 is converted into the device driving signal SD2 at a time point t1 in Step S220, the controller 130 judges in Step S230 whether a default instruction DI of the control signal SC is received. In Step S230, the controller 130 identifies the waveform of the control signal SC after the time point t1. When the controller 130 identifies that a part of the waveform of the control signal SC conforms to the waveform of the default instruction DI at a time point t2, the controller 130 separates the fan driving signal SD_FAN and the light emitting driving signal string SD_LG from the device driving signal SD2 in Step S240. In other words, the controller 130 separates the fan driving signal SD_FAN and the light emitting driving signal string SD_LG from the device driving signal SD2 at the time point t2.

In the embodiment, the device driving signal SD2 is a driving signal combined by multiple driving signals with different frequencies. For example, the light emitting driving signal strings SD_LG and the fan driving signal SD_FAN are encoded as the device driving signal SD2. In the embodiment, the frequency of the light emitting driving signal string SD_LG is significantly greater than or equal to the frequency of the fan driving signal SD_FAN. Specifically, the frequency (about several megahertz (MHz)) of the light emitting driving signal string SD_LG is greater than or equal to 10 times the frequency (about several kilohertz (kHz) to hundred kilohertz) of the fan driving signal SD_FAN. Therefore, the controller 130 can separate the fan driving signal SD_FAN and the light emitting driving signal string SD_LG from the device driving signal SD2 based on the obvious frequency difference. For another example, the light emitting driving signal string SD_LG and the fan driving signal SD_FAN are encoded as the device driving signal SD2 based on an encoding protocol (also referred to as an encoding rule). Therefore, the controller 130 can separate the fan driving signal SD_FAN and the light emitting driving signal string SD_LG from the device driving signal SD2 based on the encoding protocol (or the encoding rule).

In Step S250, the controller 130 drives the fan 110 by using the fan driving signal SD_FAN, and drives the light emitting element group 120 by using the light emitting driving signal string SD_LG. Therefore, after the time point t2, the fan 110 is driven by the fan driving signal SD_FAN. The light emitting element group 120 is driven by the light emitting driving signal string SD_LG.

In the embodiment, after the time point t2, the light emitting driving signal string SD_LG is continuously separated. For example, the light emitting driving signal string SD_LG is temporally divided into multiple segments. Each segment includes header data HD, driving data D1 to Dn, and footer data BD. In the embodiment, the light emitting element LD1 identifies the light emitting driving signal string SD_LG by the header data HD, and provides a light signal in response to the driving data D1. The light emitting element LD2 identifies the light emitting driving signal string SD_LG by the header data HD, and provides a light signal in response to the driving data D2, and so on. The footer data BD indicates an end message of each segment.

On the other hand, when the controller 130 does not identify the waveform conforming to the default instruction DI in Step S230, the driving method S200 returns to Step S210. In some embodiments, the device driving signal SD2 is maintained for a default maintaining time length. When the maintaining time of the device driving signal SD2 reaches the default maintaining time length, the device driving signal SD2 is converted into the device driving signal SD1. Therefore, the controller 130 drives the fan 110 by using the device driving signal SD1 in Step S210.

In some embodiments, between the time points t1 and t2, the controller 130 may drive the fan 110 by using the device driving signal SD2.

Figure 7:
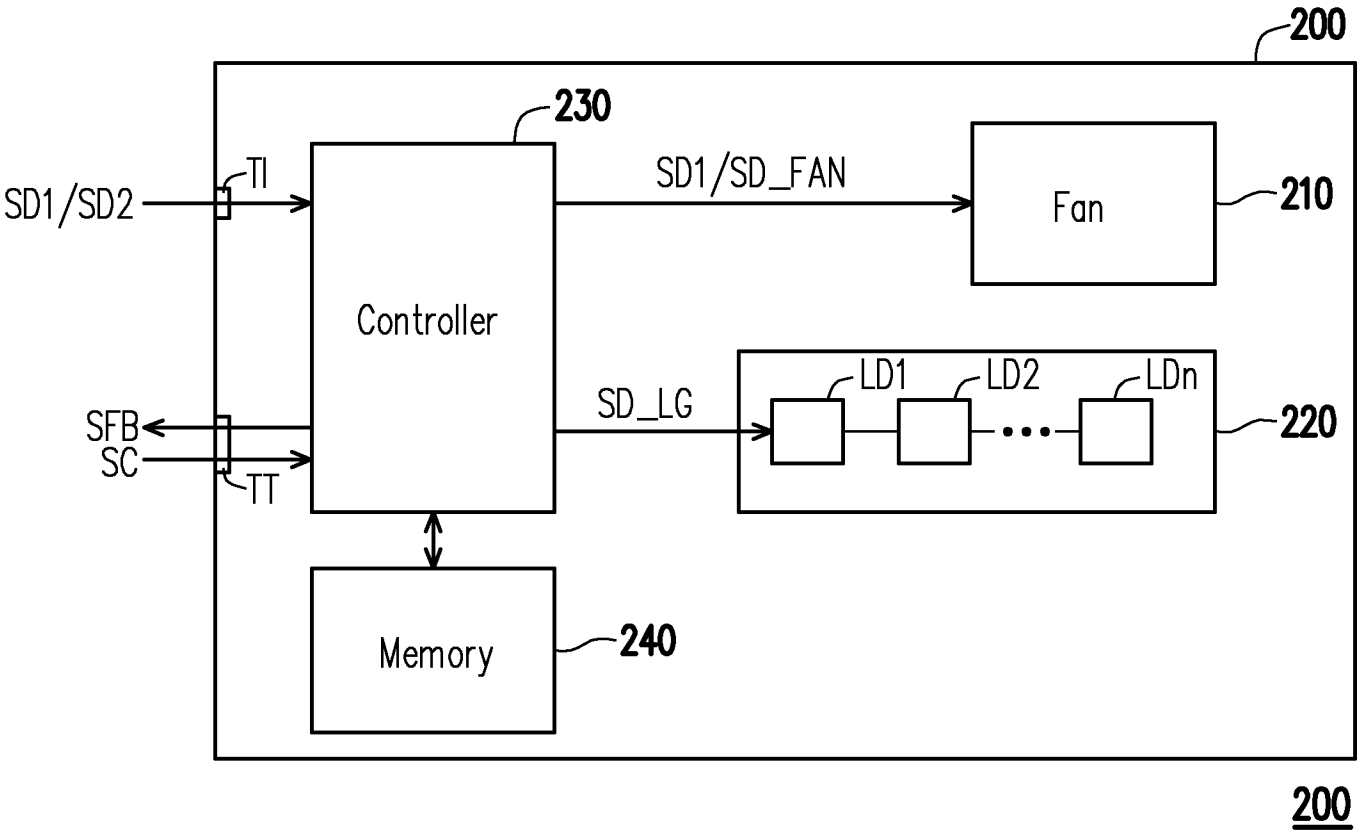
FIG. 7 is a schematic diagram of an electronic device according to a second embodiment of the disclosure.
Figure 8:
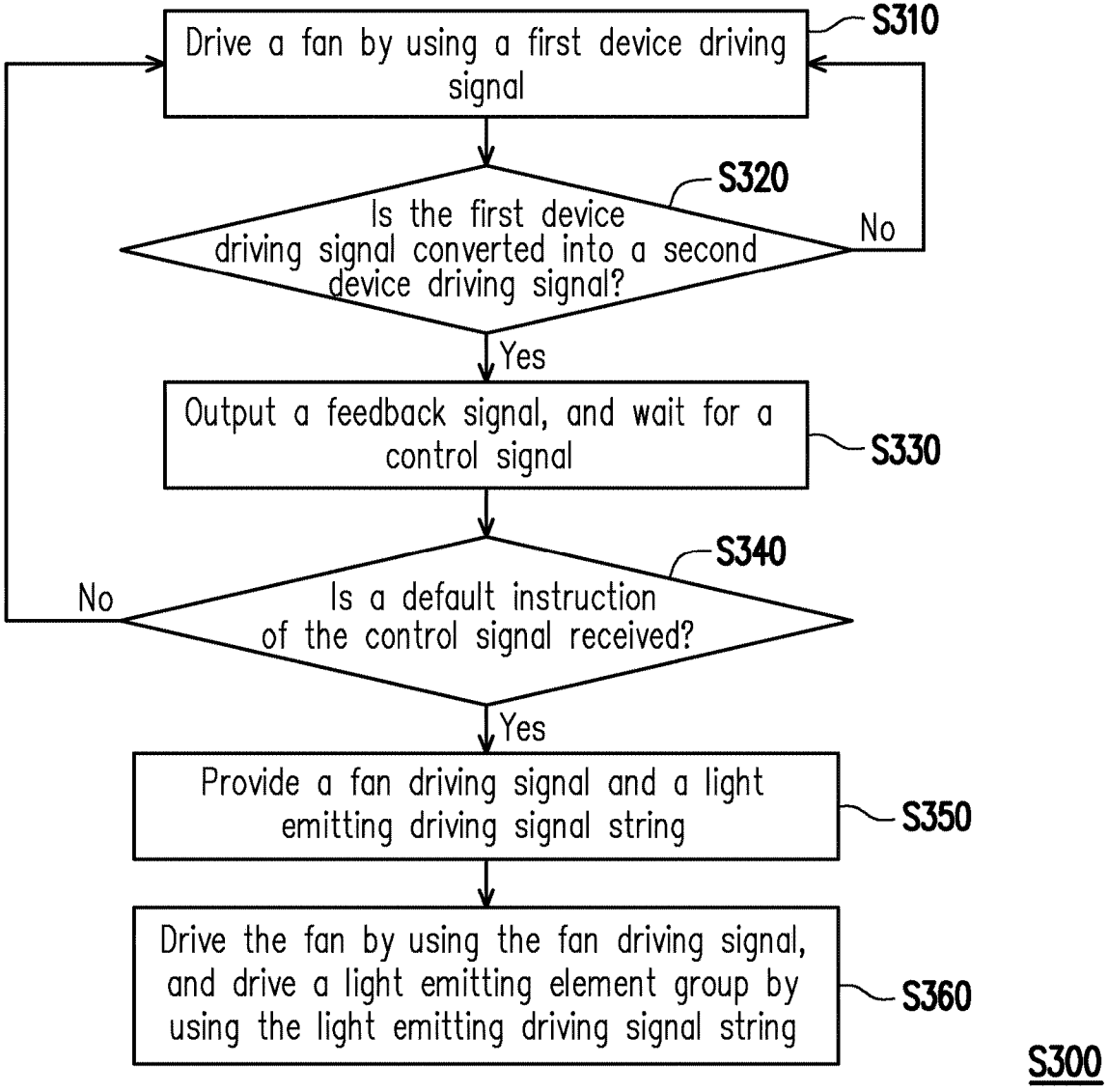
FIG. 8 is a flowchart of a third method of a driving method according to an embodiment of the disclosure.
Figure 9:
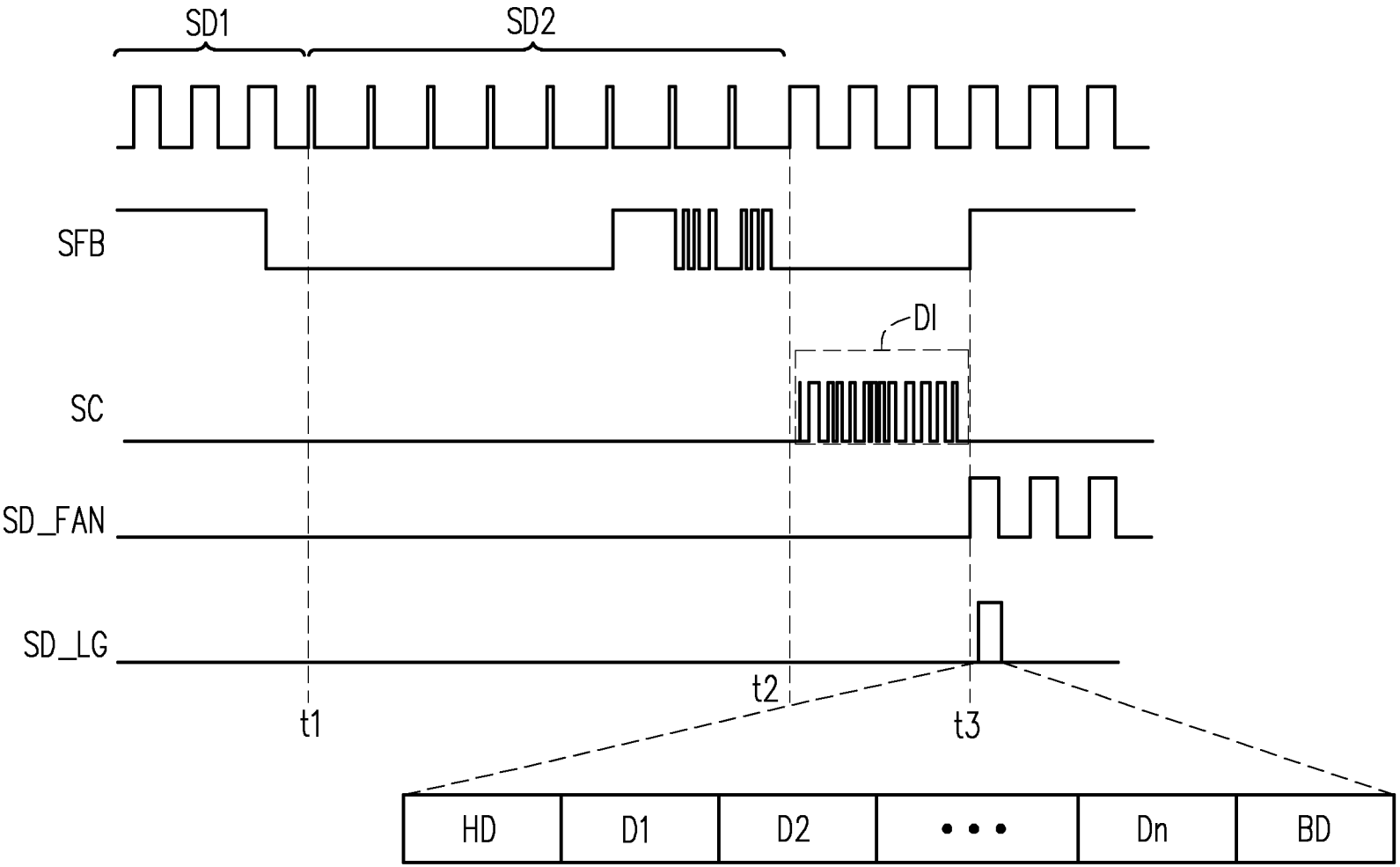
FIG. 9 is a signal timing diagram according to the second embodiment of the disclosure.

Please refer to FIG. 7, FIG. 8, and FIG. 9 at the same time. FIG. 7 is a schematic diagram of an electronic device according to a second embodiment of the disclosure. FIG. 8 is a flowchart of a third method of a driving method according to an embodiment of the disclosure. FIG. 9 is a signal timing diagram according to the second embodiment of the disclosure. In the embodiment, an electronic device 200 includes a driving signal input terminal TI, a signal transmission terminal TT, a fan 210, a light emitting element group 220, and a controller 230. The coupling manner of the fan 210, the light emitting element group 220, and the controller 230 is roughly similar to the coupling manner of the fan 110, the light emitting element group 120, and the controller 130 of FIG. 3. A driving method 300 of FIG. 8 may be applied to the electronic device 200. In Step S310 of the embodiment, the controller 230 drives the fan 210 by using a device driving signal SD1. In Step S320, the controller 230 judges whether the device driving signal SD1 is converted into a device driving signal SD2. In Step S320, if the controller 230 judges that the device driving signal SD1 is not converted into the device driving signal SD2, the driving method S300 returns to Step S310.

On the other hand, if the controller 230 judges that the device driving signal SD1 is converted into the device driving signal SD2 at a time point t1 in Step S320, the controller 230 outputs a feedback signal SFB in Step S330. In other words, the controller 230 outputs the feedback signal SFB via the signal transmission terminal TT during a time interval of receiving the device driving signal SD2. The feedback signal SFB may include operating parameters, such as an operating time length, a rotational speed, and other parameters, of the fan 210. In addition, after outputting the feedback signal SFB, the controller 230 waits for a control signal SC. Therefore, the controller 230 outputs the feedback signal SFB via the signal transmission terminal TT and receives the control signal SC via the signal transmission terminal TT. The signal transmission terminal TT of the embodiment is a bidirectional transmission terminal.

For example, the control signal SC may be provided by a signal generator (not shown). The signal generator may be connected to the controller 230 via the signal transmission terminal TT. Therefore, the signal generator may receive the feedback signal SFB and provide the control signal SC in response to the feedback signal SFB. In the embodiment, the signal generator may be disposed outside the electronic device 200. In the embodiment, the signal generator is, for example, a central processing unit, other programmable general-purpose or specific-purpose microprocessors, digital signal processors, programmable controllers, application specific integrated circuits, programmable logic devices, other similar devices, or a combination of the devices, which may load and execute a computer program.

In the embodiment, the duty cycle of the device driving signal SD1 is controlled within a first duty cycle range. The first duty cycle range is, for example, a default duty cycle range of the fan 210 under normal operation. Similarly, the duty cycle of the fan driving signal SD_FAN is also controlled within the first duty cycle range. The duty cycle of the device driving signal SD2 is controlled within a second duty cycle range. In addition, the second duty cycle range does not overlap with the first duty cycle range at all. For example, the first duty cycle range may be set to 20 to 80%. The second duty cycle range may be set to 81 to 100%. For another example, the first duty cycle range may be set to 20 to 80%. The second duty cycle range may be set to 5 to 15%. Therefore, the controller 230 can judge whether the device driving signal SD1 is converted into the device driving signal SD2 by changes in the range of the duty cycle. In the embodiment, the duty cycle of the device driving signal SD2 is, for example, 10% (but the disclosure is not limited thereto).

In Step S340, the controller 230 judges whether a default instruction DI of the control signal SC is received in Step S340. The controller 230 starts to receive the control signal SC at a time point t2, and identifies the waveform of the control signal SC after the time point t2. When the controller 130 identifies that a part of the waveform of the control signal SC conforms to the waveform of the default instruction DI at a time point t3, the controller 230 provides the fan driving signal SD_FAN and the light emitting driving signal string SD_LG in Step S350. In Step S360, the controller 230 drives the fan 210 by using the fan driving signal SD_FAN, and drives the light emitting element group 220 by using the light emitting driving signal string SD_LG. Therefore, at the time point t3, the fan 210 is driven by the fan driving signal SD_FAN. The light emitting element group 220 is driven by the light emitting driving signal string SD_LG. In the embodiment, the fan driving signal SD_FAN is provided at the time point t3 or after the time point t3.

In some embodiments, based on the data structure of the default instruction DI, the controller 230 may provide the fan driving signal SD_FAN when a part of the default instruction DI (for example, header data of the default instruction DI) of the control signal SC is received. In other words, in some embodiments, the fan driving signal SD_FAN may be provided between the time point t2 and the time point t3.

In the embodiment, the electronic device 200 further includes a memory 240. The memory may be used to store the light emitting driving signal string SD_LG and the fan driving signal SD_FAN corresponding to the default instruction DI. Therefore, in Step S350, the controller 230 provides the light emitting driving signal string SD_LG and the fan driving signal SD_FAN stored in the memory 240 based on the default instruction DI. In the embodiment, the memory 240 is disposed outside the controller 230. In some embodiments, the memory 240 may be disposed inside the controller 230. The configuration manner of the memory 240 of the disclosure is not limited to the embodiment.

Please return to Step S340. On the other hand, when the controller 230 does not identify the waveform conforming to the default instruction DI in Step S340, the driving method S300 returns to Step S310. In the embodiment, the cycle amount of the device driving signal SD2 is controlled at a default cycle amount. When the cycle of the device driving signal SD2 reaches the default cycle amount (for example, the default cycle amount is equal to 8, but the disclosure is not limited thereto), the device driving signal SD2 is stopped being provided. In the embodiment, the device driving signal SD2 may be converted into the device driving signal SD1 or a signal with other waveforms.

Figure 10:
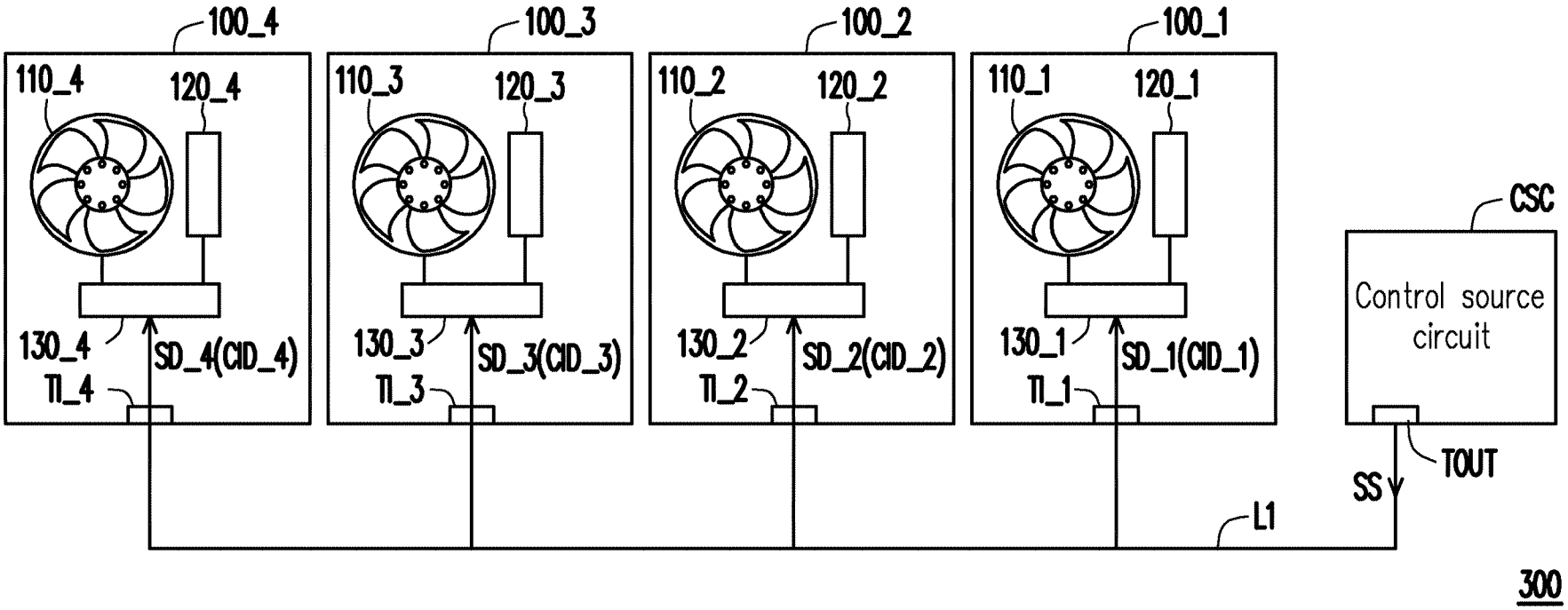
FIG. 10 is a schematic diagram of a multi-fan system according to an embodiment of the disclosure.

Please refer to FIG. 10. FIG. 10 is a schematic diagram of a multi-fan system according to an embodiment of the disclosure. In the embodiment, a multi-fan system 300 includes a control source circuit CSC and electronic devices 100_1 to 100_4. In the embodiment, the control source circuit CSC is a control core for controlling operating states or modes of the electronic devices 100_1 to 100_4. The control source circuit CSC includes a driving signal output terminal TOUT. The control source circuit CSC outputs a device driving signal string SS through the driving signal output terminal TOUT. In the embodiment, the control source circuit CSC may be operated to generate the device driving signal string SS. The device driving signal string SS includes multiple device driving signals with multiple different identification codes. Taking the embodiment as an example, the device driving signal string SS includes a device driving signal SD_1 with an identification code CID_1, a device driving signal SD_2 with an identification code CID_2, a device driving signal SD_3 with an identification code CID_3, and a device driving signal SD_4 with an identification code CID_4. In the embodiment, the control source circuit CSC also includes a signal generator (not shown) configured to provide the device driving signal string SS. The signal generator is coupled to the driving signal output terminal TOUT.

In the embodiment, the device driving signals SD_1 to SD_4 may respectively be one of the device driving signals SD1 and SD2 shown in FIG. 2, FIG. 3, FIG. 6, FIG. 7, and FIG. 9. In the embodiment, the electronic devices 100_1 to 100_4 may be respectively implemented by one of the electronic devices 100 and 200 shown in FIG. 2, FIG. 3, and FIG. 7. The electronic devices 100_1 to 100_4 are commonly coupled to the driving signal output terminal TOUT.

Each of the electronic devices 100_1 to 100_4 includes a driving signal input terminal, a fan, a light emitting element group, and a controller. Taking the embodiment as an example, the electronic device 100_1 includes a driving signal input terminal TI_1, a fan 110_1, a light emitting element group 120_1, and a controller 130_1. The electronic device 100_2 includes a driving signal input terminal TI_2, a fan 110_2, a light emitting element group 120_2, and a controller 130_2. The electronic device 100_3 includes a driving signal input terminal TI_3, a fan 110_3, a light emitting element group 120_3, and a controller 130_3. The electronic device 100_4 includes a driving signal input terminal TI_4, a fan 110_4, a light emitting element group 120_4, and a controller 130_4. In the embodiment, the driving signal input terminals TI_1 to TI_4 are electrically connected to the driving signal output terminal TOUT. In the embodiment, the driving signal input terminals TI_1 to TI_4 are electrically connected to the driving signal output terminal TOUT through a connection line L1.

In the embodiment, the controller 130_1 is coupled to the fan 110_1, the light emitting element group 120_1, and the driving signal input terminal TI_1. The controller 130_1 receives the device driving signal SD_1 in the device driving signal string SS through the driving signal input terminal TI_1. The device driving signal SD_1 has the identification code CID_1 corresponding to the electronic device 100_1. The controller 130_1 controls the operation of at least one of the fan 110_1 and the light emitting element group 120_1 based on the device driving signal SD_1. The operating manner of the controllers 130_2 to 130_4 is similar to the operating manner of the controller 130_1. The controller 130_2 controls the operation of at least one of the fan 110_2 and the light emitting element group 120_2 based on the device driving signal SD_2, and so on.

Figure 1C:
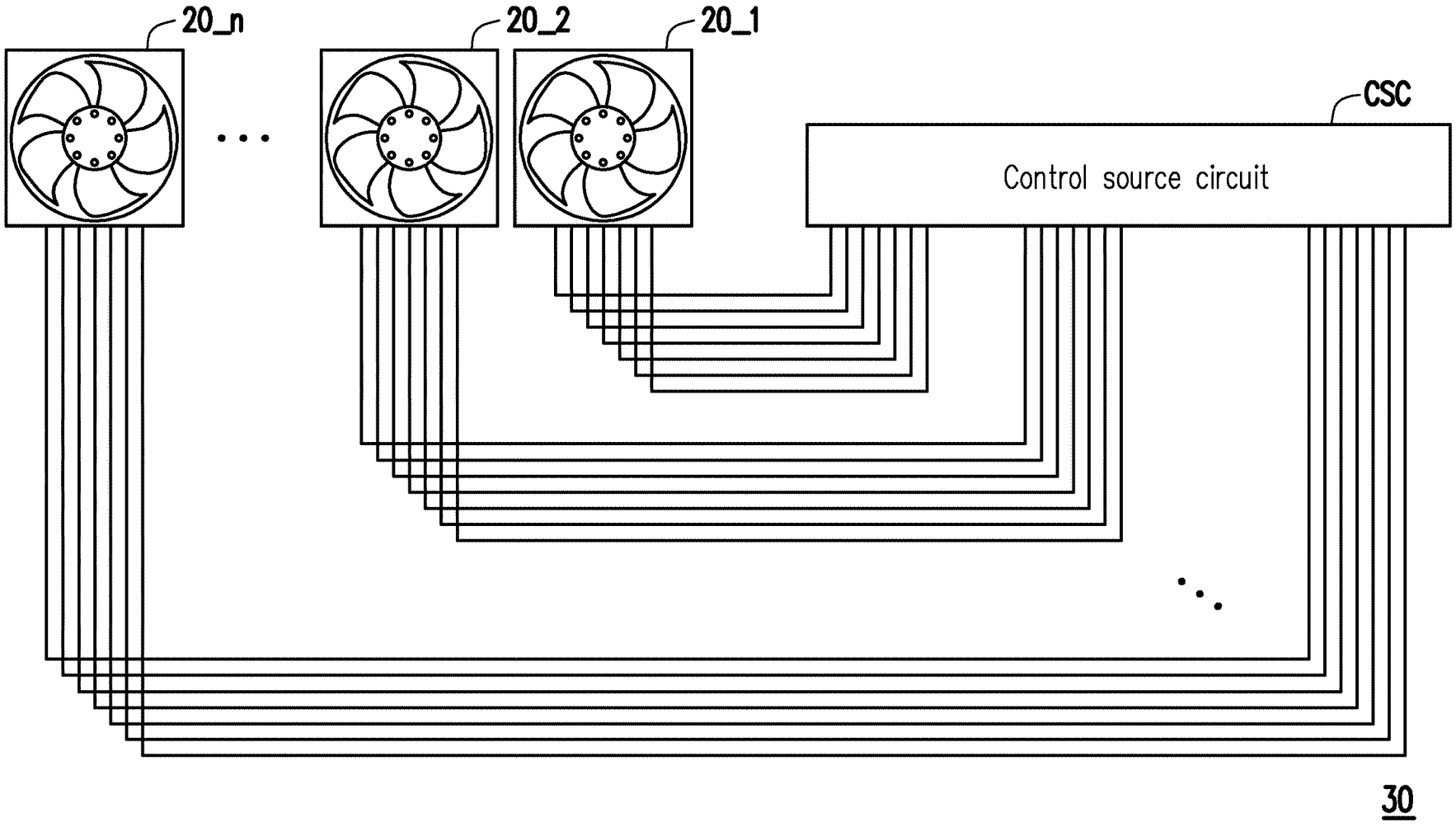
FIG. 1C is a schematic diagram of a conventional multi-fan system.

It is worth mentioning here that each of the electronic devices 100_1 to 100_4 is connected to the driving signal output terminal TOUT of the control source circuit CSC through the driving signal input terminals TI_1 to TI_4 to receive the corresponding device driving signals SD_1 to SD_4. The electronic device 100_1 controls the operation of at least one of the fan 110_1 and the light emitting driving signal string 120_1 based on the device driving signal SD_1. The electronic device 100_2 controls the operation of at least one of the fan 110_2 and the light emitting driving signal string 120_2 based on the device driving signal SD_2, and so on. Therefore, the multi-fan system 300 can enable the electronic devices 100_1 to 100_4 to drive the fans 110_1 to 110_4 and the light emitting element groups 120_1 to 120_4 by using signals received by the driving signal input terminals TI_1 to TI_4. In this way, the multi-fan system 300 can reduce the number of input terminals of the electronic devices 100_1 to 100_4 and the number of output terminals of the control source circuit CSC. Compared with the multi-fan system 30 of FIG. 1C, the multi-fan system 300 reduces the volumes of the control source circuit CSC and the electronic devices 100_1 to 100_4 and saves wire costs.

Taking the electronic device 100_1 as an example, the controller 130_1 detects the identification codes CID_1 to CID_4 of the device driving signals SD_1 to SD_4 through the driving signal input terminal TI_1 of the electronic device 100_1. When the identification code CID_1 among the identification codes CID_1 to CID_4 corresponds to a device code of the electronic device 100_1, the controller 130_1 judges that the identification code CID_1 is a corresponding identification code of a device driving signal for driving the fan 110_1 and the light emitting element group 120_1. For example, the device code of the electronic device 100_1 may be a product identifier (PID), a unique identifier (UID), or a user-defined digital code of the electronic device 100_1. For example, the identification code CID_1 is equal to at least a part of the device code of the electronic device 100_1. For another example, the identification code CID_1 is equal to the device code of the electronic device 100_1. Therefore, the controller 130_1 receives the device driving signal SD_1 with the identification code CID_1 through the driving signal input terminal TI_1, and stops receiving the device driving signals SD_2 to SD_4.

Figure 11:
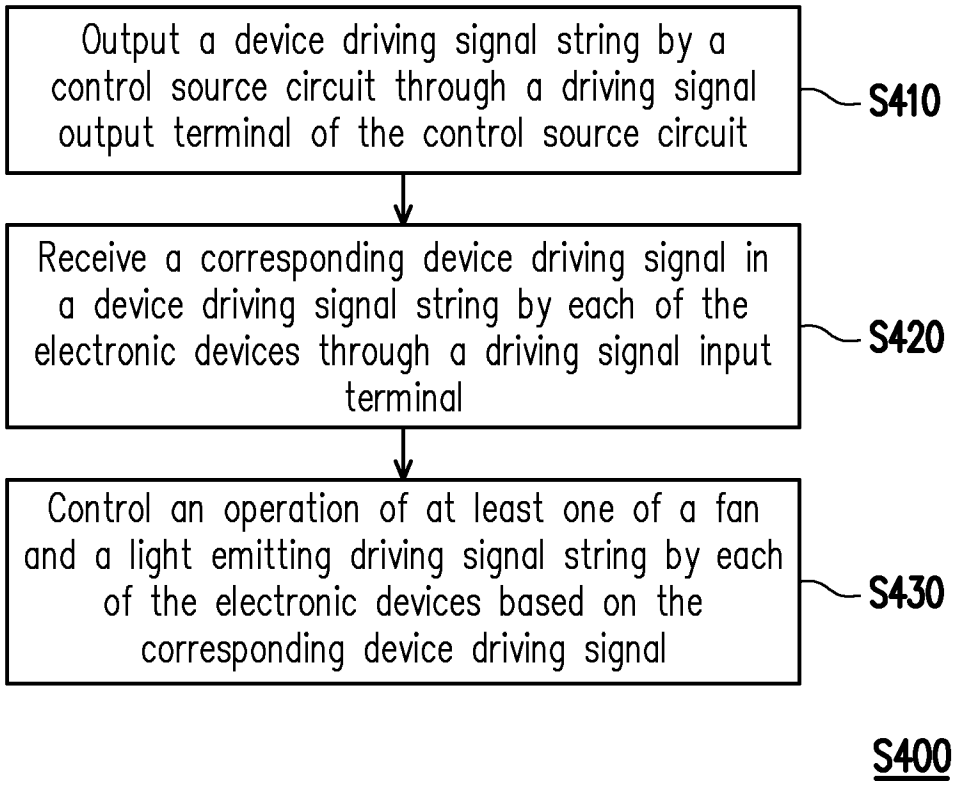
FIG. 11 is a flowchart of a method according to a driving method shown in FIG. 10.

Please refer to FIG. 10 and FIG. 11 at the same time. FIG. 11 is a flowchart of a method according to a driving method shown in FIG. 10. The driving method of FIG. 11 is applied to the multi-fan system 300. In Step S410, the control source circuit CSC outputs the device driving signal string SS through the driving signal output terminal TOUT. The device driving signal string SS includes the device driving signals SD_1 to SD_4 with multiple different identification codes. In Step S410, the control source circuit CSC provides the device driving signals SD_1 to SD_4 in sequence, thereby generating the device driving signal string SS. In Step S420, each of the electronic devices 100_1 to 100_4 receives the corresponding device driving signal in the device driving signal string SS through the driving signal input terminals TI_1 to TI_4. In Step S430, the electronic devices 100_1 to 100_4 control the operation of at least one of the fan and the light emitting driving signal string based on the corresponding device driving signal. The implementation details of Steps S410 to S430 have been described in detail in the embodiment of FIG. 10, so there will be no repetition.

Figure 12:
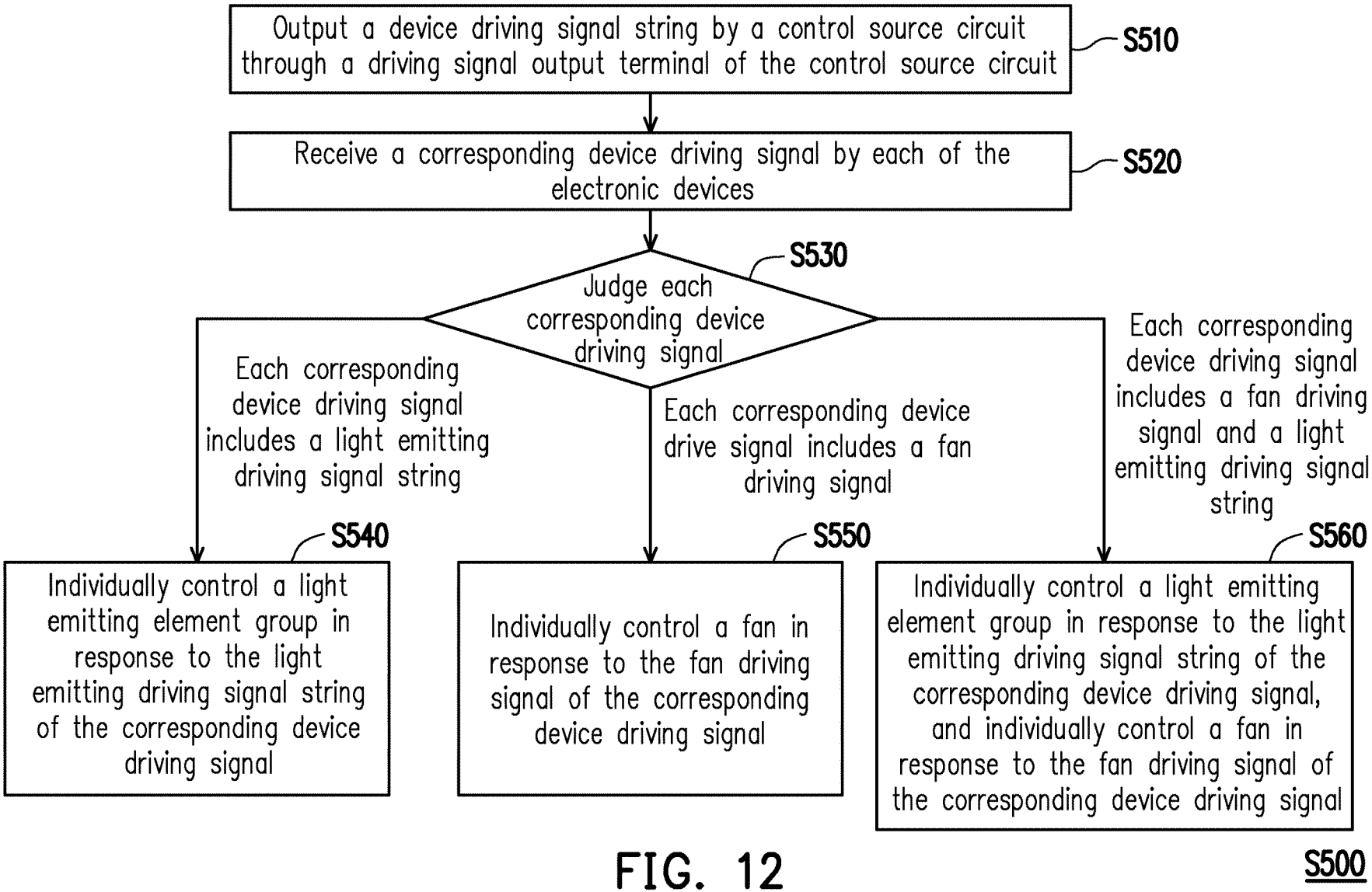
FIG. 12 is a flowchart of another method according to the driving method shown in FIG. 10.
Figure 13:
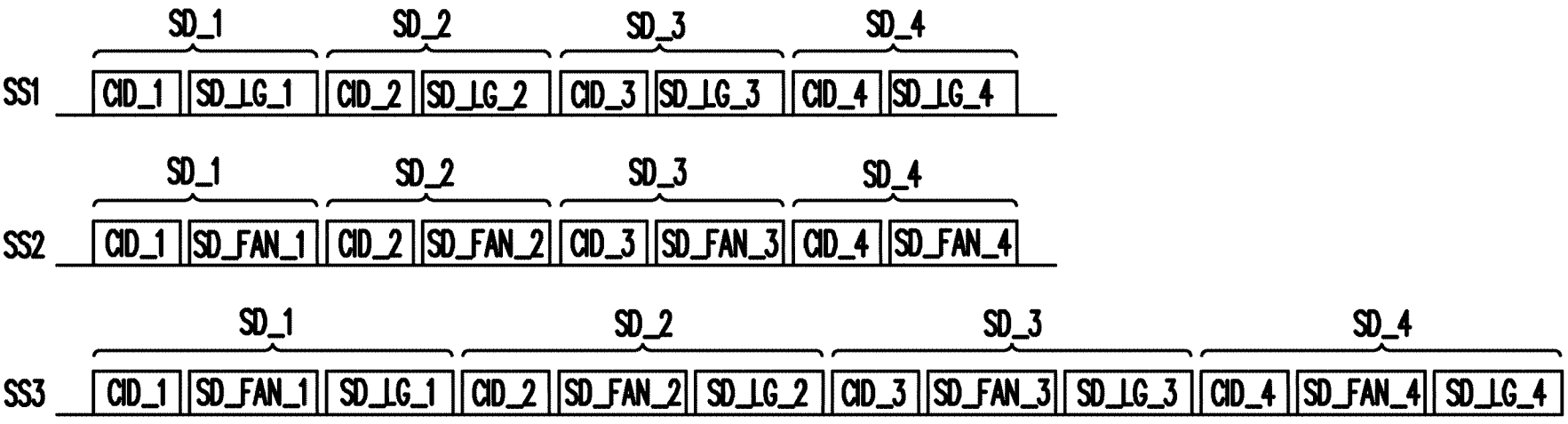
FIG. 13 is a schematic diagram of a device driving signal string according to an embodiment of the disclosure.

Please refer to FIG. 10, FIG. 12, and FIG. 13 at the same time. FIG. 12 is a flowchart of another method according to the driving method shown in FIG. 10. FIG. 13 is a schematic diagram of a device driving signal string according to an embodiment of the disclosure. In Step S510, the control source circuit CSC outputs the device driving signal string through the driving signal output terminal TOUT. In the embodiment, the control source circuit CSC may provide one of device driving signal strings SS1, SS2, and SS3 shown in FIG. 14. The device driving signal string SS1 includes the device driving signals SD_1 to SD_4. The device driving signal SD_1 includes the identification code CID_1 and a light emitting driving signal string SD_LG_1. The device driving signal SD_2 includes the identification code CID_2 and a light emitting driving signal string SD_LG_2. The device driving signal SD_3 includes the identification code CID_3 and a light emitting driving signal string SD_LG_3. The device driving signal SD_4 includes the identification code CID_4 and a light emitting driving signal string SD_LG_4.

The device driving signal string SS2 includes the device driving signals SD_1 to SD_4. The device driving signal SD_1 includes the identification code CID_1 and a fan driving signal SD_FAN_1. The device driving signal SD_2 includes the identification code CID_2 and a fan driving signal SD_FAN_2. The device driving signal SD_3 includes the identification code CID_3 and a fan driving signal SD_FAN_3. The device driving signal SD_4 includes the identification code CID_4 and a fan driving signal SD_FAN_4.

The device driving signal string SS3 includes the device driving signals SD_1 to SD_4. The device driving signal SD_1 includes the identification code CID_1, the fan driving signal SD_FAN_1, and the light emitting driving signal string SD_LG_1. The device driving signal SD_2 includes the identification code CID_2, the fan driving signal SD_FAN_2, and the light emitting driving signal string SD_LG_2. The device driving signal SD_3 includes the identification code CID_3, the fan driving signal SD_FAN_3, and the light emitting driving signal string SD_LG_3. The device driving signal SD_4 includes the identification code CID_4, the fan driving signal SD_FAN_4, and the light emitting driving signal string SD_LG_4.

In Step S520, based on the identification codes CID_1 to CID_4, the controllers 130_1 to 130_4 respectively receive the corresponding device driving signal of one of the device driving signal strings SS1, SS2, and SS3. In Step S530, the controllers 130_1 to 130_4 judge a content of each corresponding device driving signal. The controllers 130_1 to 130_4 judge that each of the device driving signals SD_1 to SD_4 includes the light emitting driving signal string. In other words, the device driving signal SD_1 includes the light emitting driving signal string SD_LG_1. The device driving signal SD_2 includes the light emitting driving signal string SD_LG_2, and so on. Therefore, in Step S540, the controller 130_1 controls the light emitting element group 120_1 in response to the light emitting driving signal string SD_LG_1. The controller 130_2 controls the light emitting element group 120_2 in response to the light emitting driving signal string SD_LG_2, and so on. In other words, during the period when the control source circuit CSC provides the device driving signal string SS1, the controllers 130_1 to 130_4 individually control the light emitting element groups 120_1 to 120_4 in response to the received light emitting driving signal string of the corresponding device driving signal.

If the controllers 130_1 to 130_4 judge that each of the device driving signals SD_1 to SD_4 includes the fan driving signal in Step S530. In other words, the device driving signal SD_1 includes the fan driving signal SD_FAN_1. The device driving signal SD_2 includes the fan driving signal SD_FAN_2, and so on. Therefore, in Step S550, the controller 130_1 controls the fan 110_1 in response to the fan driving signal SD_FAN_1. The controller 130_2 controls the fan 110_2 in response to the fan driving signal SD_FAN_2, and so on. In other words, during the period when the control source circuit CSC provides the device driving signal string SS2, the controllers 130_1 to 130_4 individually control the fans 110_1 to 110_4 in response to the received fan driving signal of the corresponding device driving signal.

If the controllers 130_1 to 130_4 judge that each of the device driving signals SD_1 to SD_4 includes the fan driving signal and the light emitting driving signal string in Step S530. In other words, the device driving signal SD_1 includes the fan driving signal SD_FAN_1 and the light emitting driving signal string SD_LG_1. The device driving signal SD_2 includes the fan driving signal SD_FAN_2 and the light emitting driving signal string SD_LG_2, and so on. Therefore, in Step S560, the controller 130_1 controls the fan 110_1 in response to the fan driving signal SD_FAN_1, and controls the light emitting element group 120_1 in response to the light emitting driving signal string SD_LG_1. The controller 130_2 controls the fan 110_2 in response to the fan driving signal SD_FAN_2, and controls the light emitting element group 120_2 in response to the light emitting driving signal string SD_LG_2, and so on. In other words, during the period when the control source circuit CSC provides the device driving signal string SS3, the controllers 130_1 to 130_4 individually control the fans 110_1 to 110_4 and the light emitting element groups 120_1 to 120_4 in response to the received fan driving signal of the corresponding device driving signal.

Therefore, the controllers 130_1 to 130_4 may provide independent control or synchronous control based on different contents of the device driving signal strings SS1, SS2, and SS3.

Figure 14:
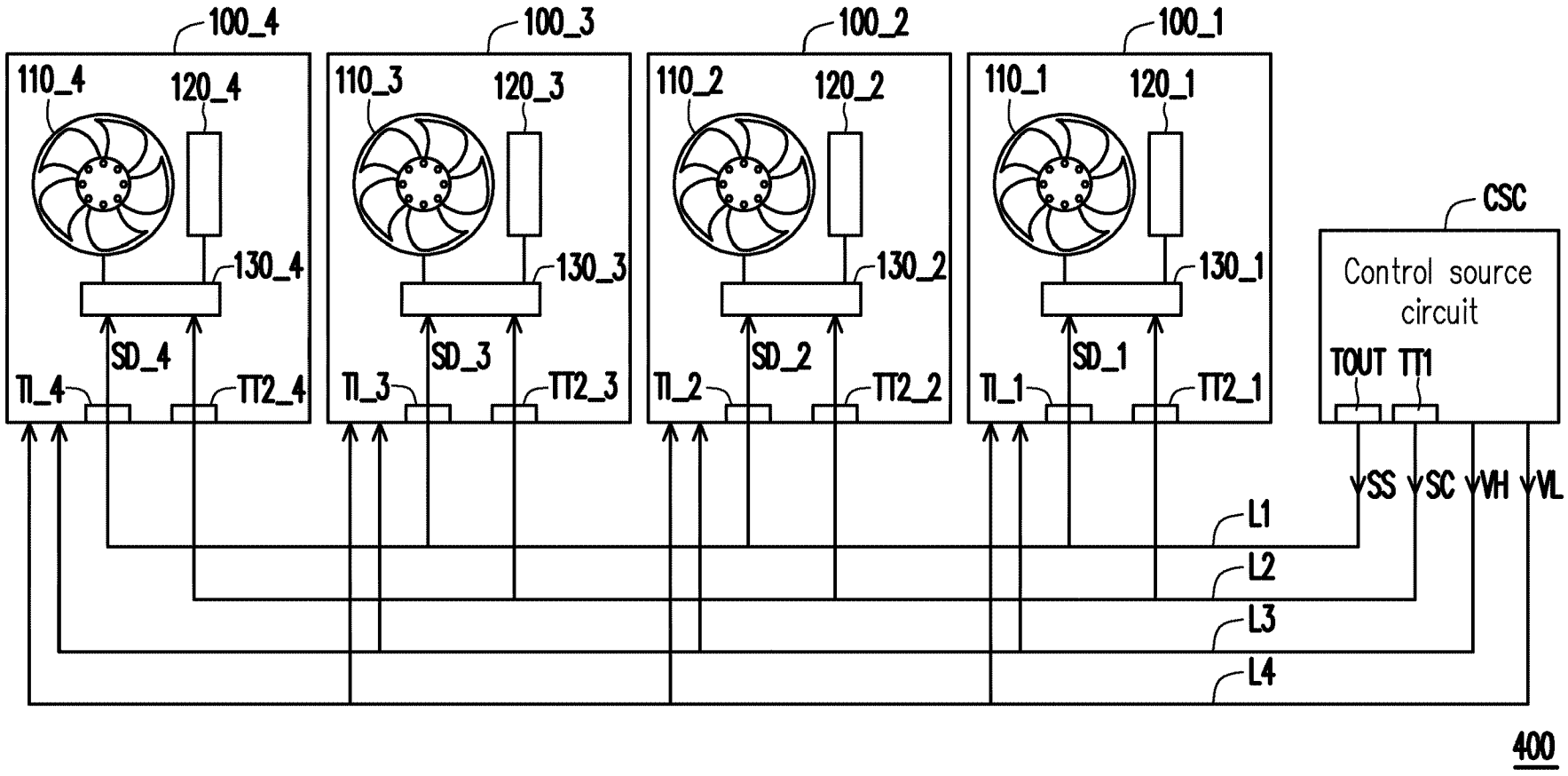
FIG. 14 is a schematic diagram of a multi-fan system according to another embodiment of the disclosure.

Please refer to FIG. 14. FIG. 14 is a schematic diagram of a multi-fan system according to another embodiment of the disclosure. In the embodiment, a multi-fan system 400 includes a control source circuit CSC and electronic devices 100_1 to 100_4. Different from the multi-fan system 300, the control source circuit CSC also includes a signal transmission terminal TT1. The electronic device 100_1 also includes a signal transmission terminal TT2_1. The electronic device 100_2 also includes a signal transmission terminal TT2_2. The electronic device 100_3 also includes a signal transmission terminal TT2_3. The electronic device 100_4 also includes a signal transmission terminal TT2_4. In the embodiment, the electronic devices 100_1 to 100_4 are respectively electrically connected to the signal transmission terminal TT1 via the signal transmission terminals TT2_1 to TT2_4. Further, the signal transmission terminals TT2_1 to TT2_4 are electrically connected to the signal transmission terminal TT1 through a connection line L2. The control source circuit CSC can provide a control signal SC to the electronic devices 100_1 to 100_4 via the signal transmission terminal TT1.

In the embodiment, the control source circuit CSC also provides a power source VH to the electronic devices 100_1 to 100_4 through a connection line L3 and provides a power source VL to the electronic devices 100_1 to 100_4 through a connection line L4. In the embodiment, the power source VH is a power source for driving the electronic devices 100_1 to 100_4. The power source VL is a ground voltage.

In some embodiments, during the period when the control source circuit CSC provides a device driving signal string SS and the control signal SC, controllers 130_1 to 130_4 respectively separate at least one of the light emitting driving signal string (the light emitting driving signal string SD_LG shown in FIG. 6) and the fan driving signal (the fan driving signal SD_FAN shown in FIG. 6) from the received device driving signal based on the control signal SC. The embodiments of FIG. 3, FIG. 5, and FIG. 6 clearly illustrate the implementation details of the controller 130 separating the light emitting driving signal string SD_LG and the fan driving signal SD_FAN from the device driving signal SD2. Therefore, the implementation details of the controllers 130_1 to 130_4 of the embodiments generating the light emitting driving signal strings and the fan driving signals are clearly illustrated in the embodiments of FIG. 3, FIG. 5, and FIG. 6, so there will be no repetition.

In some embodiments, during the period when the control source circuit CSC provides the device driving signal string SS, the controllers 130_1 to 130_4 respectively output the feedback signal (the feedback signal SFB shown in FIG. 9) via the signal transmission terminals TT2_1 to TT2_4, and wait for the control source circuit CSC to provide the control signal SC. When receiving the control signal SC, the controllers 130_1 to 130_4 respectively provide at least one of the fan driving signal (the fan driving signal SD_FAN shown in FIG. 9) and the light emitting driving signal string (the light emitting driving signal string SD_LG shown in FIG. 9) according to the received device driving signals SD_1 to SD_4. The embodiments of FIG. 7, FIG. 8, and FIG. 9 clearly illustrate the implementation details of the embodiments, so there will be no repetition.

In summary, each of the electronic devices of the disclosure is connected to the driving signal output terminal of the control source circuit through the driving signal input terminal to receive the corresponding device driving signal. The electronic devices respectively control the operation of at least one of the fan and the light emitting element group based on the corresponding device driving signal. Therefore, the disclosure can enable the electronic device to drive at least one of the fan and the light emitting element group by using the signal received by the driving signal input terminal. In this way, the disclosure can reduce the number of input terminals of the electronic device and the number of output terminals of the control source circuit, thereby reducing the volumes of the control source circuit and the electronic device and saving wire costs.

Although the disclosure has been disclosed in the above embodiments, the embodiments are not intended to limit the disclosure. Persons skilled in the art may make some changes and modifications without departing from the spirit and scope of the disclosure. Therefore, the protection scope of the disclosure shall be defined by the appended claims.

What is claimed is:

1. A multi-fan system, comprising:

a control source circuit, comprising:

a driving signal output terminal, wherein the control source circuit outputs a device driving signal string through the driving signal output terminal, wherein the device driving signal string comprises a plurality of device driving signals with different identification codes; and a plurality of electronic devices, commonly coupled to the driving signal output terminal, each comprising:

a driving signal input terminal, electrically connected to the driving signal output terminal;

a fan;

a light emitting element group; and a controller, coupled to the fan, the light emitting element group, and the driving signal input terminal, and configured to receive a corresponding device driving signal in the device driving signal string through the driving signal input terminal, wherein the corresponding device driving signal has a corresponding identification code corresponding to a corresponding electronic device among the electronic devices, and controls an operation of at least one of the fan and the light emitting element group based on the corresponding device driving signal.

2. The multi-fan system according to claim 1, wherein the control source circuit provides the device driving signals in sequence.

3. The multi-fan system according to claim 1, wherein a first controller of a first electronic device among the electronic devices is configured to:

detect the identification codes of the device driving signals through a first driving signal input terminal of the first electronic device, when a first identification code among the identification codes corresponds to a device code of the first electronic device, judge that the first identification code is the corresponding identification code, and receive a first device driving signal with the first identification code among the device driving signals through the first driving signal input terminal, and stop receiving other device driving signals.

4. The multi-fan system according to claim 1, wherein:

each of the device driving signals further comprises a light emitting driving signal string, and the controller of each of the electronic devices receives the corresponding device driving signal, and individually controls the light emitting element group in response to a light emitting driving signal string of the corresponding device driving signal.

5. The multi-fan system according to claim 1, wherein:

each of the device driving signals further comprises a fan driving signal, and the controller of each of the electronic devices receives the corresponding device driving signal, and individually controls the fan in response to a fan driving signal of the corresponding device driving signal.

6. The multi-fan system according to claim 1, wherein:

each of the device driving signals further comprises a light emitting driving signal string and a fan driving signal, and the controller of each of the electronic devices receives the corresponding device driving signal, individually controls the light emitting element group in response to a light emitting driving signal string of the corresponding device driving signal, and individually controls the fan in response to a fan driving signal of the corresponding device driving signal.

7. The multi-fan system according to claim 1, wherein:

the control source circuit further comprises a first signal transmission terminal, each of the electronic devices further comprises a second signal transmission terminal, the electronic devices are respectively electrically connected to the first signal transmission terminal via the second signal transmission terminal, and the control source circuit provides a control signal to the electronic devices via the first signal transmission terminal.

8. The multi-fan system according to claim 7, wherein during a period when the control source circuit provides the device driving signal string and the control signal, the controller of each of the electronic devices separates at least one of a light emitting driving signal string and a fan driving signal from the corresponding device driving signal based on the control signal.

9. The multi-fan system according to claim 7, wherein:

during a period when the control source circuit provides the device driving signal string, the controller of each of the electronic devices outputs a feedback signal via the second signal transmission terminal, and waits for the control signal, and when receiving the control signal, the controller of each of the electronic devices provides at least one of the fan driving signal and the light emitting driving signal string according to the corresponding device driving signal.

10. A driving method for a multi-fan system, wherein the multi-fan system comprises a control source circuit and a plurality of electronic devices, wherein the control source circuit is electrically connected to the electronic devices, wherein the control source circuit comprises a driving signal output terminal, wherein each of the electronic devices comprises a driving signal input terminal, a fan, and a light emitting element group, wherein the driving method comprises:

outputting a device driving signal string by the control source circuit through a driving signal output terminal of the control source circuit, wherein the device driving signal string comprises a plurality of device driving signals with different identification codes;

receiving a corresponding device driving signal in the device driving signal string by each of the electronic devices through the driving signal input terminal, wherein the corresponding device driving signal has a corresponding identification code corresponding to a corresponding electronic device among the electronic devices; and controlling an operation of at least one of the fan and the light emitting element group by each of the electronic devices based on the corresponding device driving signal.

11. The driving method according to claim 10, wherein the control source circuit provides the device driving signals in sequence.

12. The driving method according to claim 10, wherein the step of receiving the corresponding device driving signal in the device driving signal string comprises:

detecting the identification codes of the device driving signals through a driving signal input terminal of a first electronic device among the electronic devices;

when a first identification code among the identification codes corresponds to a device code of the first electronic device, judging that the first identification code is the corresponding identification code; and receiving a first device driving signal with the first identification code among the device driving signals through the driving signal input terminal, and stopping receiving other device driving signals.

13. The driving method according to claim 10, wherein each of the device driving signals further comprises a light emitting driving signal string, wherein the step of controlling the operation of at least one of the fan and the light emitting element group by each of the electronic devices based on the corresponding device driving signal comprises:

individually controlling the light emitting element group in response to a light emitting driving signal string of the corresponding device driving signal.

14. The driving method according to claim 10, wherein each of the device driving signals further comprises a fan driving signal, wherein the step of controlling the operation of at least one of the fan and the light emitting element group by each of the electronic devices based on the corresponding device driving signal comprises:

individually controlling the fan in response to a fan driving signal of the corresponding device driving signal.

15. The driving method according to claim 10, wherein each of the device driving signals further comprises a light emitting driving signal string and a fan driving signal, wherein the step of controlling the operation of at least one of the fan and the light emitting element group by each of the electronic devices based on the corresponding device driving signal comprises:

individually controlling the light emitting element group in response to a light emitting driving signal string of the corresponding device driving signal, and individually controlling the fan in response to a fan driving signal of the corresponding device driving signal.

16. The driving method according to claim 10, wherein the control source circuit further comprises a first signal transmission terminal, wherein each of the electronic devices further comprises a second signal transmission terminal, wherein the electronic devices are respectively electrically connected to the first signal transmission terminal via the second signal transmission terminal, wherein the driving method further comprises:

providing a control signal to the electronic devices by the control source circuit via the first signal transmission terminal.

17. The driving method according to claim 16, further comprising:

during a period when the control source circuit provides the device driving signal string and the control signal, separating at least one of a light emitting driving signal string and a fan driving signal from the corresponding device driving signal by each of the electronic devices based on the control signal.

18. The driving method according to claim 16, further comprising:

during a period when the control source circuit provides the device driving signal string, outputting a feedback signal by the controller of each of the electronic devices via the second signal transmission terminal, and waiting for the control signal; and when receiving the control signal, providing at least one of the fan driving signal and the light emitting driving signal string by the controller of each of the electronic devices according to the corresponding device driving signal.

* * * * *